US005720830A

United States Patent [19]

Wragg et al.

[11] Patent Number: 5,720,830

[45] Date of Patent: Feb. 24, 1998

[54] ENGINEERING FERROUS METALS AND METHOD OF MAKING THEREOF

[75] Inventors: David Wragg, Crewe; Paul Herbert Hewitt, Nether Staples; Jack Nutting, Leeds, all of United Kingdom

[73] Assignee: Sheffield Forgemasters Limited, Rotherham, United Kingdom

[21] Appl. No.: 735,380

[22] Filed: Oct. 21, 1996

Related U.S. Application Data

[63] Continuation of Ser. No. 436,395, filed as PCT/GB93/02380, Nov. 19, 1993, abandoned.

[30] Foreign Application Priority Data

Nov. 19, 1992 [GB] United Kingdom ..... 9224271.8
Jul. 23, 1993 [GB] United Kingdom ..... 9315356.7

[51] Int. Cl.[6] ..... C22C 38/04; C22C 38/08; C22C 38/00

[52] U.S. Cl. ..... 148/326; 148/328; 148/539; 148/540; 148/541; 148/542; 148/543; 75/10.6; 75/566; 75/10.25

[58] Field of Search ..... 75/10.59, 10.6, 75/10.61, 566, 10.25, 312; 148/543, 542, 538, 540, 329, 324, 321, 326, 328

[56] References Cited

U.S. PATENT DOCUMENTS 3,885,956 5/1975 Obst et al. ..... 75/312
5,023,145 6/1991 Lomax et al. ..... 428/614

FOREIGN PATENT DOCUMENTS 58-213813 12/1983 Japan ..... 75/566
WO93/03192 2/1993 WIPO .

*Primary Examiner*—Deborah Yee
*Attorney, Agent, or Firm*—Marshall O'Toole; Gerstein, Murray & Borun

[57] ABSTRACT

A method of making an engineering ferrous metal comprising the steps of adding to liquid engineering ferrous metal solid alloy carbide particles and thereafter permitting the ferrous metal to solidify. The alloy carbide particles are coated with iron or an iron alloy to allow wetting to occur between the powder and the liquid ferrous metal and the particles have a density which matches that of the ferrous metal to provide a uniform distribution of the carbide particles in the ferrous metal. A roll may be made having at least a shell made of metal by such a method by centrifugal casting or electroslag remelting.

60 Claims, 8 Drawing Sheets

Figure 1:
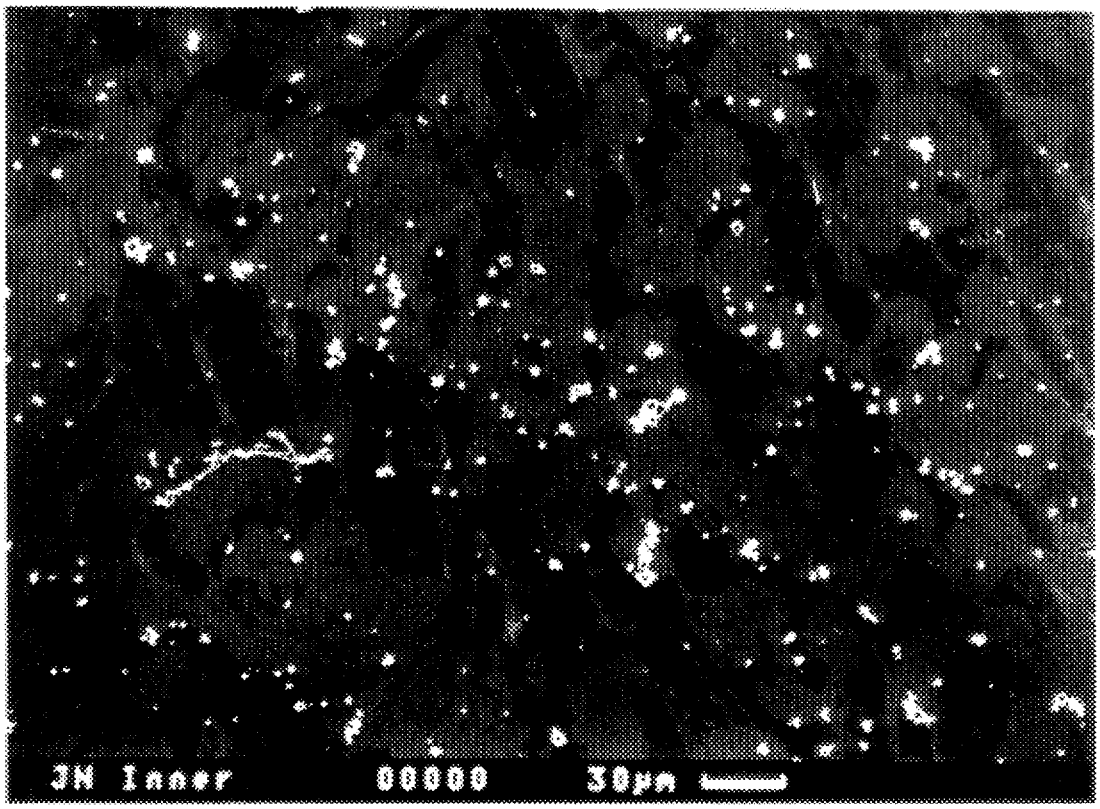

Fig. 12
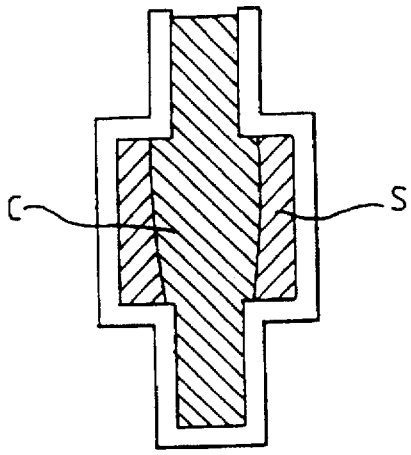
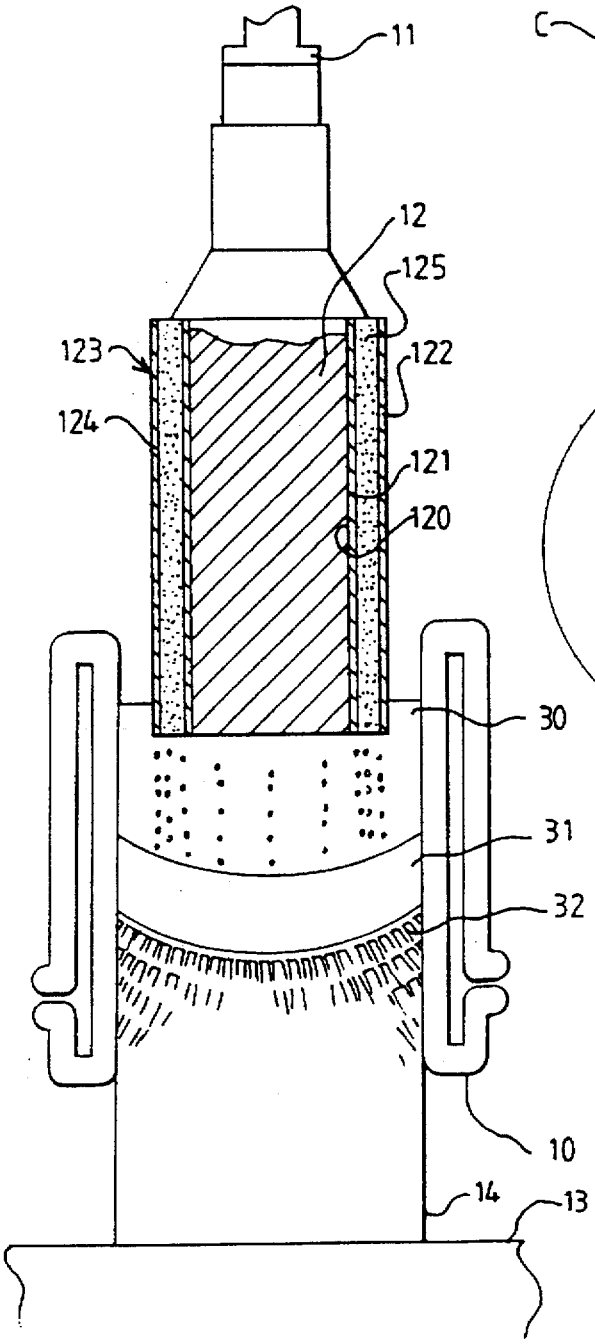
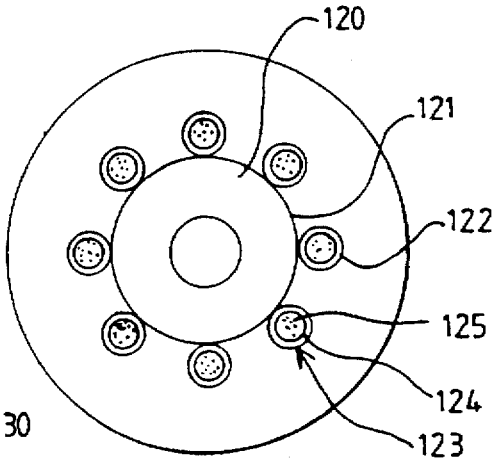
Fig. 14
Fig. 13

ENGINEERING FERROUS METALS AND METHOD OF MAKING THEREOF

This a Continuation of U.S. application Ser. No. 08/436,395, filed May 18, 1995, now abandoned which a national stage filing of PCT/GB93/02380 filed on Nov. 19, 1993.

This invention relates to cast iron and steel, hereinafter referred to as "engineering ferrous metals".

Mechanical properties of engineering ferrous metals are influenced by the presence of carbides whose distribution and formation is dependent upon carbon content, heat treatment and the addition of other alloying elements. Carbon is added to engineering ferrous metals whilst the cast iron and steel is molten and the carbon is subsequently precipitated as metal carbides during solidification and during phase transformation in the solid state. Such carbides are referred to herein as "transformation carbides". Thus, the type and the amount of transformation carbide present in engineering ferrous metals is limited by the thermo-dynamics and chemistry of a particular ferrous metal and are represented by the relevant phase diagram.

There has been a long standing desire to provide carbides of different composition and volume fraction in engineering ferrous metals than is possible by the previously known techniques described above which rely on phase transformation as the metal cools from liquid state.

An object of the invention is to provide a new and improved method of making engineering ferrous metals whereby the above mentioned problems are overcome or are reduced and a further object of the invention is to provide a new and improved engineering ferrous metal having a desired carbide content which is not limited by thermodynamic considerations.

According to one aspect of the invention we provide a method of making an engineering ferrous metal comprising the steps of adding to liquid engineering ferrous metal solid alloy carbide particles and thereafter permitting the ferrous metal to solidify.

Preferably the solid carbide particles are coated with a metal which allows wetting to occur between the particles and the liquid engineering ferrous metal. By "wetting" we mean the ability of the liquid engineering ferrous metal to wet the coating metal. More particularly, for example, where the interfacial tension between the liquid engineering ferrous metal and the solid coating metal is such that the contact angle therebetween is 0°–90° C.

The alloy carbide particles preferably have a density which matches that of the engineering ferrous metal.

By "matches" we mean a density preferably lying in the range 6–8 gms per cc. This is to be compared with a typical density of 7 gms per cc. for cast iron and steel. More preferably, the alloy carbide particles have a density of ±5% of the density of the engineering ferrous metal to which they are added.

The wettability of the coated particles and the density of the alloy carbide particles each promote a uniform distribution of the carbide particles in the liquid engineering ferrous metal which is retained when the metal solidifies.

By a "uniform distribution" we mean an even distribution throughout the section of a casting made of the engineering ferrous metal with no significant segregation. The solid carbide particles are not orientated in any direction and are distributed across all phases of the micro-structure.

The coating metal preferably comprises iron or an iron carbon alloy, but may comprise an alloy of two or more elements selected from the group comprising iron, nickel, copper, titanium and carbon, or may be nickel or copper and usual incidentals.

The coating metal may comprise nitrogen, for example up to about 0.1% nitrogen.

If the coating is iron, then because iron has a higher melting point than the engineering ferrous metal to which it is to be added, which would inhibit wettability, it is preferred to add an appropriate amount of at least one alloying element such as carbon, nickel copper or titanium to the iron to produce an alloy having a melting point which matches the operating temperature of the ferrous metal. By "matches" we mean that the melting point of the coating and said operating temperature are preferably within approximately 20°–30° C. of each other.

By "operating temperature" we mean the temperature of the engineering ferrous metal whilst the coated carbide particles are added.

The iron coating may contain up to 3.5% carbon.

If the alloy carbide particles are coated with iron or with an iron alloy having a lower carbon content than that of the engineering ferrous metal to which they are added the coated alloy carbide particles may be added to the engineering ferrous metal and permitted to dwell therein sufficiently long for carbon from the engineering ferrous metal to diffuse into the coating and so produce a composition which has a melting point which matches the operating temperature of engineering ferrous metal.

It is particularly preferred that the carbide particles have a matching density as described above when the particles are left in the molten engineering ferrous metal for a dwell time long enough for carbon to diffuse into the coating to cause the melting points to match.

If desired, the composition of the coating metal may be such as to provide a melting point which is more than 30° C. below the operating temperature of the engineering ferrous metal to which the coated particles are added, The coated alloy carbide particles may be added to the liquid engineering ferrous metal either in the melting furnace or in a ladle into which the metal has been poured from the melting furnace, or in the stream of metal being poured from the melting furnace to the ladle, or in the stream of metal being poured from the ladle into a mould.

It is preferred to add the coated alloy carbide particles in the melting furnace so as to maximise the dwell time of the alloy carbide particles in the ferrous metal prior to the onset of solidification.

It is particularly preferred that the melting furnace is an induction furnace, since an induction furnace provides good stirring of the melt.

We have found that the titanium of the carbide oxidises to form titanium oxide which can react with silicon from the furnace lining to form a hard crust on the metal surface which may entrap the carbide particles and reduce their distribution in the molten metal.

In order to avoid or reduce this problem we prefer to add the coated alloy carbide particles to the engineering ferrous metal in an inert environment, for example, an atmosphere of an inert gas such as argon or under vacuum.

The coated alloy carbide particles may be added to the ferrous engineering metal melt in the form of a powder comprising powder particles having a particle size up to 2 mm and preferably of about 500 microns and containing alloy carbide particles having a particle size of up to 10 microns and preferably in the range 1–5 microns and more preferably 2–5 microns.

The powder particles may comprise:

| | |
|---|---|
| 25% | coating metal. |
| 30% | Ti |
| 35% | W |
| Balance | Carbon (including up to 3.5% free carbon) and usual incidentals). |

The coating metal may comprise iron such as alpha iron and may comprise wholly or substantially wholly alpha iron and up to 3.5% free carbon.

Such a coating metal has a melting point of about 1520° C. and hence the powder is suitable for adding to engineering ferrous metal having an operating temperature of about 1500° C. or above.

Alternatively the coating metal may comprise an alloy of iron, nickel and carbon.

In this case the powder and alloy carbide particles may be of the same size as mentioned above and the powder particles may comprise:

| | |
|---|---|
| 27% | coating metal. |
| 30% | Ti |
| 35% | W |
| Balance | Carbon including up to 0.5% free carbon) and usual incidentals. |

The coating material may comprise an alloy of iron, nickel and carbon:

| | |
|---|---|
| 59% | nickel |
| 41% | iron and up to 0.5% free carbon and usual incidentals. |

Such a coating metal has a melting point of about 1420° C. and is particularly suitable for adding to engineering ferrous metals having an operating temperature of below about 1500° C.

If powder having an alpha iron matrix is added to metal having such a relatively low operating temperature, it is found that the powder may not break down enough at the temperature of the melt for best distribution of the alloy carbide particles in the melt. With such engineering ferrous metal compositions it is not possible to increase the temperature of the melt because the iron tends to become a "white" iron as a result of superheat inhibiting the formation of graphite. White iron is unsuitable for such a roll material.

If desired, the coating metal may be an alloy of either iron, nickel and copper or iron and copper with or without carbon in each case to provide a lower melting point.

Where the coating metal contains significant amounts of carbon, for example, 2–3.5%, it has been found that the product to which the power has been added is softer than expected because more graphite is transformed in the metal. It is believed that this is due to the free carbon in the relatively fine powder particles acting as an inoculant. Accordingly the carbon content of the powder is preferably reduced to less than about 0.5% in order to minimise the softening effect.

However, where the product is a roll used in an application where spalling due to cycles of reversed thermal stress is likely, it may be desirable to increase the amount of graphite in the product since graphite provides a better thermal resistance and hence resistance to spalling.

Where the coating metal contains nickel a similar softening effect can occur even though the coating metal has relatively low carbon, e.g. 0.5%. This softening effect can be overcome or reduced by adjusting the chemical composition of the engineering ferrous metal.

Alternatively the coated alloy carbide particles may be added during an electroslag remelting operation.

According to a second aspect of the present invention we provide an engineering ferrous metal product comprising an iron carbon alloy having a micro-structure which has resulted from phase transformation on cooling and having dispersed therein discrete alloy carbide particles.

The microstructure may comprise matrix and carbide which have resulted from phase transformation of the engineering ferrous metal; said carbide being referred to herein, as mentioned hereinbefore, as "transformation carbide".

The discrete alloy carbide particles preferably have a higher hardness than the transformation carbide present in the microstructure.

The discrete alloy carbide particles may increase the hardness of the engineering ferrous metal by virtue of the law of mixtures and/or the phase transformation of the engineering ferrous metal may be modified and enhanced by the presence of the discrete alloy carbide particles.

The discrete alloy carbide particles may be distributed in the matrix and/or the transformation carbide.

The discrete alloy carbide particles may be uniformly distributed in the microstructure.

In both the first and the second aspects of the invention:

The alloy carbide particles may have a hardness of about 3,000 vpn.

The alloy carbide is preferably selected from the group comprising chromium, molybdenum, titanium, tungsten, niobium, vanadium or mixed carbides thereof such as $Cr_7C_3$, $(CrMo)_7C_3$ or mixed carbo-nitrides.

The alloy carbide preferably has a composition so that the above mentioned matching density is achieved. For example, the carbide may be a mixed tungsten titanium carbide of the kind (TiW)C where the ratio of titanium to tungsten is about 1:1 by weight.

The alloy carbide may comprise Ti and W in the ratio range:

1:1 to 1:1.17

The alloy carbide may contain nitrogen, for example up to about 0.1% nitrogen.

The alloy carbide preferably comprises:

| | |
|---|---|
| 42% | Ti |
| 49% | W |
| 9% | C and usual residuals |

The alloy carbide may contain up to 0.1% nitrogen.

The alloy carbide particles have a very low co-efficient of thermal expansion compared to the co-efficient of thermal expansion of engineering ferrous metals. Accordingly, if relatively large alloy carbide particles were present in the engineering ferrous metals this would give rise to high stresses on cooling, causing dislocations to form, and leading to thermal fatigue.

The alloy carbide particles preferably have a maximum dimension of up to 10 microns and preferably 1–5 microns and more preferably 2–5 microns.

The amount of alloy carbide particles added is such as to achieve up to 20% by volume of alloy carbide particles in the solid metal. Generally, the alloy carbide content may be in the range 0.1 to 20% by volume, and may be in the range 1 to 20% and more preferably 3 to 10% when a hardening effect based on the law of mixtures is provided. However, the alloy carbide content may be lower, e.g. down, for example from about 1%, to about 0.5% or 0.1% or less when a hardening effect based on a modification of the transformation of the microstructure is provided.

The engineering ferrous metals are preferably steel or cast iron having a carbon content lying in the range 0.3–3.8%.

The engineering ferrous metals may contain chromium and may have a chromium content which is greater than or equal to 1%.

The engineering ferrous metal may contain nitrogen, for example up to 0.1% nitrogen.

Where the coating metal, and/or the alloy carbide and/or the engineering ferrous metal contains nitrogen it is considered that titanium carbo-nitrides may be precipitated in the microstructure of the engineering ferrous metal. The total nitrogen content of all the components may be limited to about 0.1% nitrogen.

The engineering ferrous metal may have a composition falling within one of the following ranges:

Indefinite Chill such as:

| T.C. | Si | Mn | Ni | Cr | Mo | Cu | V |
|---|---|---|---|---|---|---|---|
| 3.00 | 0.70 | 0.40 | 3.0 | 0.8 | 0.15 | 0.10 | up to |
| 3.50 | 1.20 | 1.40 | 5.5 | 2.0 | 0.50 | 1.00 | 0.50 |

Chromium Irons such as:

| T.C. | Si | Mn | Ni | Cr | Mo | Cu | V |
|---|---|---|---|---|---|---|---|
| 2.00 | 0.40 | 0.40 | 0.40 | 10.00 | 0.50 | 0.10 | 0.10 |
| 3.00 | 2.00 | 1.50 | 1.50 | 20.00 | 3.00 | 2.00 | 0.50 |

High Alloy Steels such as:

| T.C. | Si | Mn | Ni | Cr | Mo | V | W |
|---|---|---|---|---|---|---|---|
| 0.50 | 0.40 | 0.40 | 0.10 | 5.00 | 0.50 | 0.00 | 0.00 |
| 1.50 | 0.80 | 1.00 | 1.00 | 15.00 | 5.00 | 5.00 | 5.00 |

Tool Steels such as:

| T.C. | Si | Mn | Ni | Cr | Mo | M | W |
|---|---|---|---|---|---|---|---|
| 1.00 | 0.30 | 0.30 | — | 11.00 | 0.70 | 0.80 | 1.00 |
| 2.00 | 0.40 | 0.50 | — | 13.00 | 1.00 | 1.20 | 1.40 |

or

| T.C. | Si | Mn | Ni | Cr | Mo | V | W |
|---|---|---|---|---|---|---|---|
| 0.90 | 0.40 | 0.80 | 0.00 | 10.00 | 2.50 | 2.50 | 0.00 |
| 0.95 | 0.50 | 0.85 | 0.10 | 11.00 | 3.00 | 3.00 | 0.50 |

| S | P |
|---|---|
| 0.00 | 0.00 |
| 0.02 | 0.02 |

Such a steel may be used for the finishing stands, of a hot strip steel mill.

Medium Alloy Steels such as:

| T.C. | Si | Mn | Ni | Cr | Mo | V | W |
|---|---|---|---|---|---|---|---|
| 0.30 | 0.40 | 0.40 | 0.10 | 2.00 | 0.10 | 0.10 | 0.10 |
| 1.50 | 0.80 | 1.00 | 1.00 | 5.00 | 0.50 | 0.50 | 0.50 |

Low Alloy Steels such as:

| T.C. | Si | Mn | Ni | Cr | Mo | V | W |
|---|---|---|---|---|---|---|---|

-continued

| | | | | | | | |
|---|---|---|---|---|---|---|---|
| 0.30 | 0.40 | 0.40 | 0.10 | 0.10 | 0.10 | 0.10 | 0.10 |
| 1.50 | 0.80 | 1.00 | 1.00 | 2.00 | 0.50 | 0.50 | 0.50 |

S.G. Irons such as:

| T.C. | Si | Mn | Ni | Cr | Mo | Cu |
|---|---|---|---|---|---|---|
| 2.50 | 0.90 | 0.10 | 0.10 | 0.00 | 0.00 | 0.00 |
| 3.70 | 3.00 | 1.00 | 5.00 | 1.00 | 2.00 | 2.00 |

In all cases, iron and usual incidentals comprise the balance.

Nitrogen, for example up to 0.1%, may also be present where appropriate.

According to a third aspect of the invention we provide a rolling mill roll having at least an outer part which comprises an engineering ferrous metal according to the second aspect of the invention or an engineering ferrous metal made according to the first aspect of the invention.

According to a fourth aspect of the invention, we provide a method of making a rolling mill roll wherein a metal made according to the first aspect of the invention or according to the second aspect of the invention is cast to make at least an outer part of the rolling mill roll.

In a first alternative, the rolling mill roll may be a composite rolling mill roll of the kind having a core and an outer shell with, optionally, at least one intermediate layer, in which the shell comprises said outer part.

The alloy carbide particles may be introduced into a molten engineering ferrous metal of which the shell is to be formed and then the engineering ferrous metal with the alloy carbide particles therein may be poured into a mould.

The carbide particles may be introduced into the mould under a protective atmosphere of inert gas such as argon, or under a vacuum.

The composite roll may be made by centrifugal casting.

In a second alternative, a roll may be made by performing an electroslag remelting operation on a consumable electrode which comprises an inner body provided with an external cladding comprising a hollow element containing said coated alloy carbide particles.

The inner body may be tubular or solid.

The hollow element may comprise a sleeve or a plurality of discrete hollow elements such as tubes.

The material inside the or each hollow element may also comprise a powder alloy ingredient(s).

The powder of the alloy element may have a mesh size of less than 3 mm, but may have a mesh size up to 5mm and may lie in the range 2–5 mm.

Each hollow element or hollow sleeve may comprise steel, such as mild steel or stainless steel.

Where the cladding comprises discrete elements, at least one of the elements may be of different composition to the other elements.

The inner body may be of constant composition throughout its cross-section or it may be of varying composition across at least part of its cross-section.

The droplets of molten coated alloy carbide or of molten coated alloy carbide and alloy ingredient from the hollow elements, because of their spatial and temperature proximity to the mould wall, solidify relatively rapidly at or adjacent to the mould wall whereby the region of the re-melted ingot adjacent the mould wall has a relatively high and uniform distribution of alloy carbide or carbide and alloy ingredient. Of course, if the alloy carbide particles do not wholly melt they are trapped in the melt adjacent the mould wall as it solidifies relatively rapidly.

At or adjacent to the centre of the ingot there may be a relatively low uniform distribution of alloy carbide particles or carbide particles and alloy ingredient.

The melting point of the alloy ingredient and/or of the alloy carbides may be greater than the melting point of the slag and of the inner part of the consumable electrode.

The outer pan of the ingot may be hardened by a dispersion hardening effect of the alloy carbides.

Alternatively, the outer part of the rolled ingot may be hardened, additionally, or alternatively, by a secondary hardening heat treatment operation.

The electroslag remelting operation may be performed to provide a roll comprising an inner part having a first composition and a surface part having a second composition which is different from the first composition and the metal of the roll between the inner part and the surface part having a composition which changes from the first composition to the second composition without discontinuity. This may be achieved by inter-relating the voltage, and current and the slag composition of the electroslag remelting operation so that the molten bath is relatively flat.

Instead or in addition, the cooling rate of the mould may be adjusted as may be the rate of movement of the mould.

Alternatively, the electroslag remelting operation may be performed to provide a roll of substantially uniform composition throughout the cross-section of the roll.

By "electroslag remelting" we mean a process in which a consumable electrode is melted beneath an electrical conductive slag in a moving mould from the lower end of which a continuously cast ingot emerges the electrode is heated by thermal conduction from the slag and the slag is heated by electrical conduction from the electrode through the slag to a counter-electrode provided by the ingot.

In third and fourth alternatives, the roll may be a composite roll made by ESR cladding or spray cladding. In ESR cladding an arbor is clad using the electroslag re-melting method either utilising a wire feed as the stock material or a hollow electrode. In the former case, the coated particles may be introduced by a powder feed into the molten pool. In the latter case, either a powder feed may be used, or preferably, the coated particles may be incorporated into the hollow electrode during the primary melting and casting operation in a similar way to the production of the shell metal described above.

In spray cladding, the coated particles may be incorporated into a spray deposited layer. It is possible to produce a spray deposited layer hardened by the coated carbide particles of sufficient depth to provide the full working life of a rolling mill roll.

In a fifth alternative, a roll may be made by monobloc static casting where a roll is made simply by filling a stationary mould with a single engineering ferrous metal.

In a sixth alternative a roll may be made by a double poured static casting method wherein a roll is made by first partly filling a mould up to the top of a barrel part of the roll with an engineering ferrous metal of a desired composition for an outer shell part of the roll, made by the method of the first aspect of the invention or according to the second aspect of the invention which is provided with carbide particles, and, when an outer part of the shell metal has solidified, a metal of a desired core composition is fed into the bottom of the mould to dilute the first metal until a predetermined amount of metal has been displaced from an overflow between the ends and generally about halfway up, an upper journal part of the mould, the overflow is then closed and filling of the mould with the second metal is completed.

In a seventh alternative a roll is made by casting an ingot of metal made according to the first aspect of the invention or according to the second aspect of the invention and then forging the ingot to provide a forged roll followed by heat treating the forged roll.

A roll according to the present invention fulfils a market demand which has hitherto not been satisfactorily met by providing a roll having greater fracture toughness and spall resistance as well as having improved wear resistance.

A roll embodying the present invention is intended for use in the finishing stands of hot and cold strip mills. It may be used for roughing stands in hot strip mills and for other flat rolling purposes.

More particularly, a roll having said outer part made of the engineering ferrous metals listed below are intended for use in the respective applications specified.

| | |
|---|---|
| Indefinite Chill | All Stands Hot Strip |
| Chrome Iron | Early Stands Hot Strip |
| Chrome Iron | Cold Strip Mills |
| Alloy Steel | Hot Strip Mills |
| Tool Steel | Finishing Stands cold or hot Strip Mill |

The core may be flake, compact/vermicular or nodular cast iron, steel or other suitable material.

By providing particles which have a density which matches that of the engineering ferrous metal into which they are introduced segregation as a result of spin casting is avoided.

The spinning process tends to segregate less dense particles to the bore of the shell. Alloy carbide particles having a density which matches the parent metal results in the alloy carbide particles being distributed evenly throughout the section of the shell and not being centrifuged to the bore.

Engineering ferrous metals made by a method embodying the first aspect of the invention or according to the second aspect of the invention may be usefully used in other spin casting processes, for example, for producing liners for diesel engines and pipes such as for gas or oil, or other spin cast articles. Such as hollow sleeves for use in beam mills and other sections.

According to a fifth aspect of the invention, we provide a method of making a spun cast product wherein a metal made according to the first aspect of the invention or according to the second aspect of the invention is poured into a spin casting mould and a spin casting operation is performed thereon.

The invention, however, is not limited to products made by spin or centrifugal casting. The invention may be applied to a wide range of engineering ferrous metals for many purposes.

The engineering ferrous metals can be cast into conventional ingot moulds and subsequently forged into components, for example rolling mill rolls.

Rolls manufactured in this way would typically be hardened to a martensitic or bainite structure and would be used for the cold rolling of steel. For these applications a uniform structure is required to impart a uniform finish to the cold rolled product.

It is surprising that the carbide particles are distributed uniformly throughout the matrix and within the transformation carbide of the microstructure since it would be expected that on solidification the solidifying phase would push the alloy carbide particles in front of the solidifying liquid metal interface so that one would expect the alloy carbide particles to be segregated at the grain boundaries.

Figure 2:
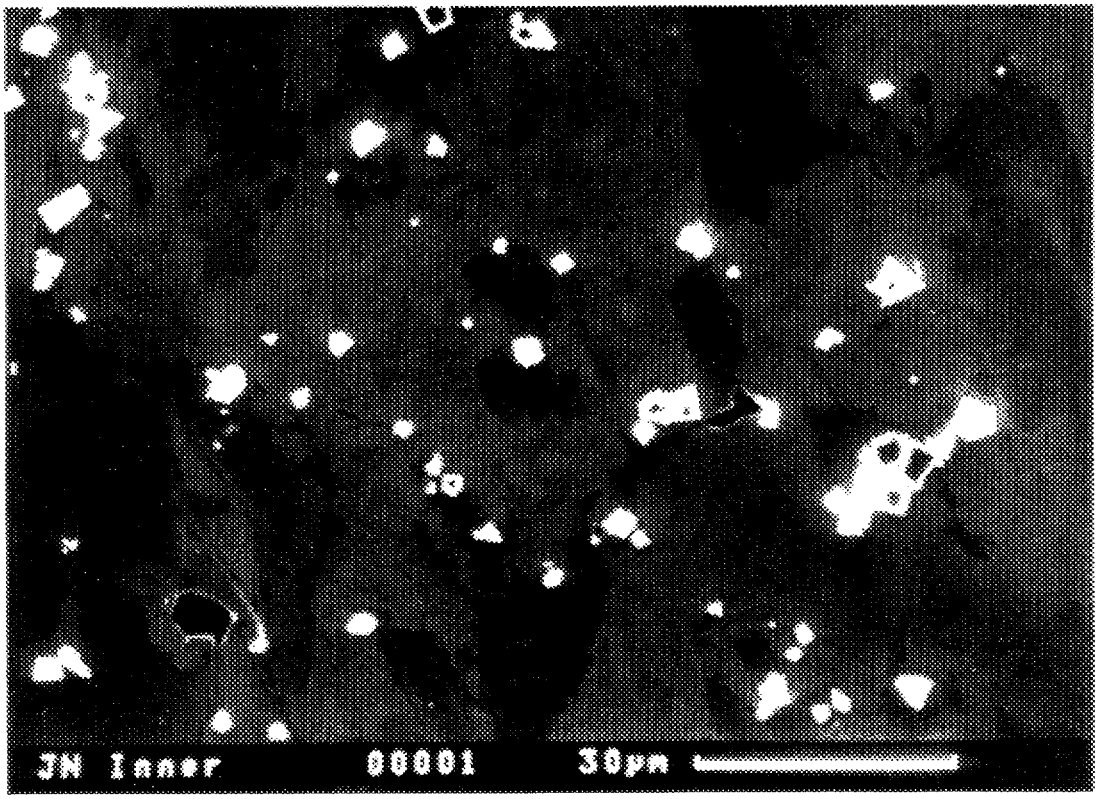
Figure 3:
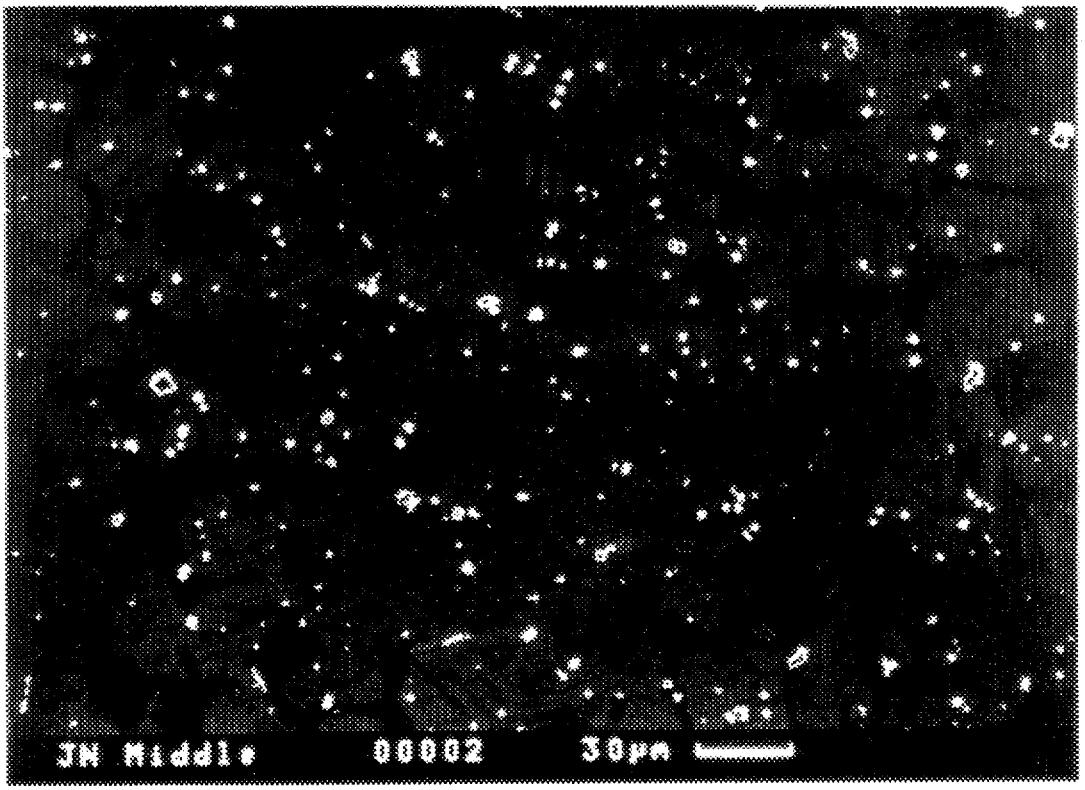
Figure 4:
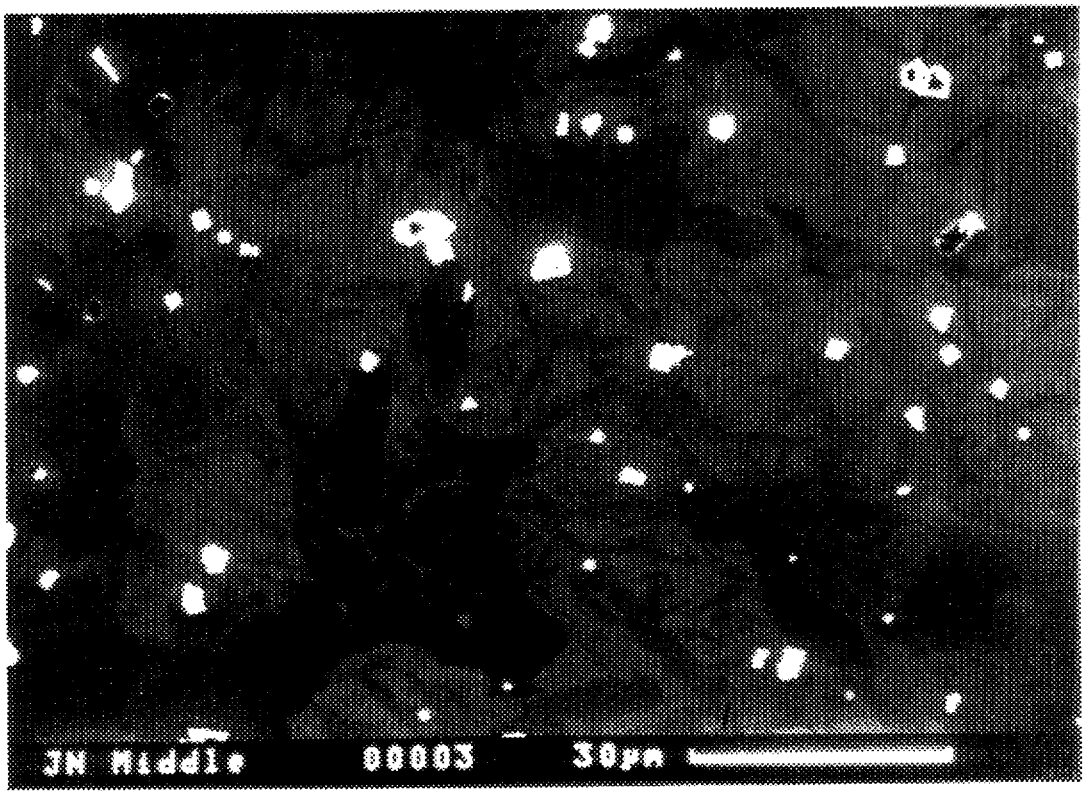
Figure 5:
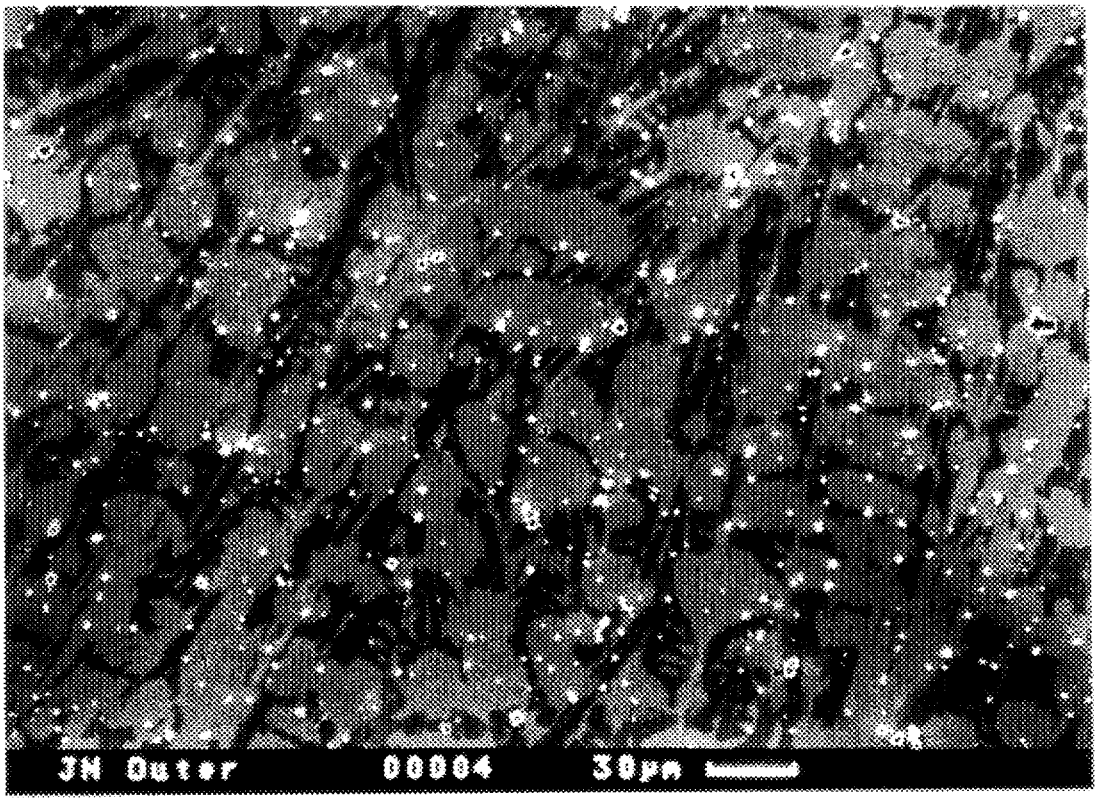
Figure 6:
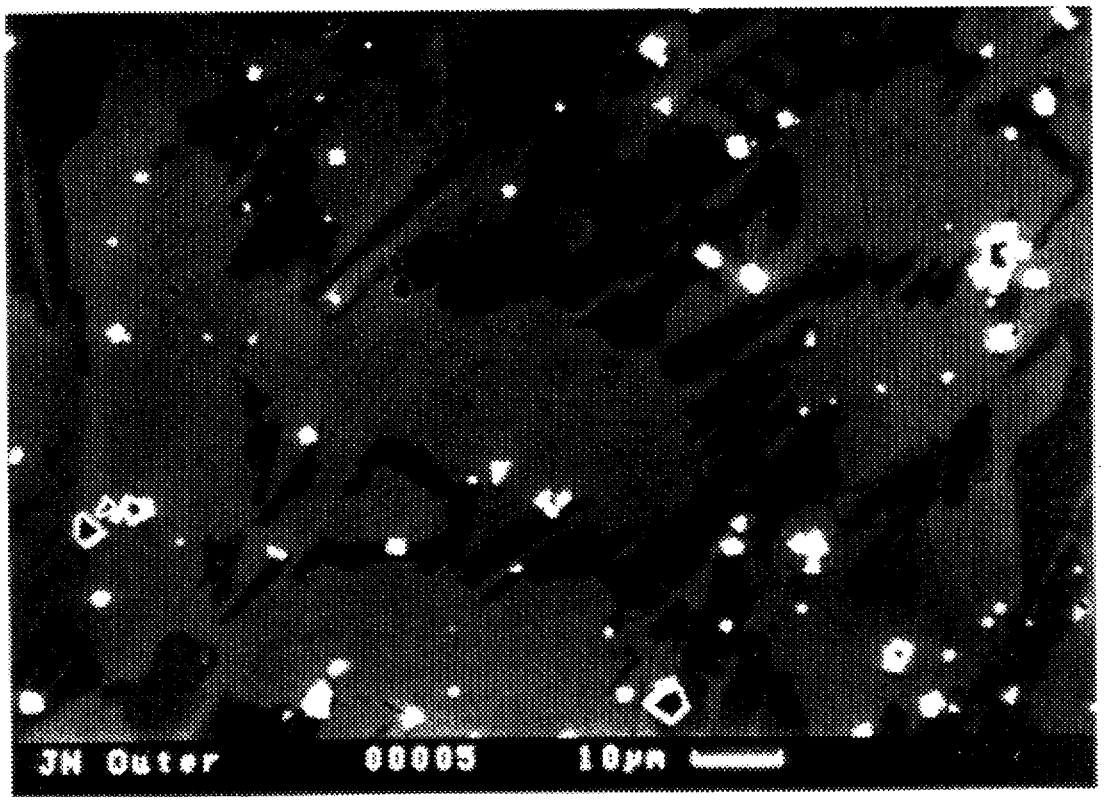
Figure 7:
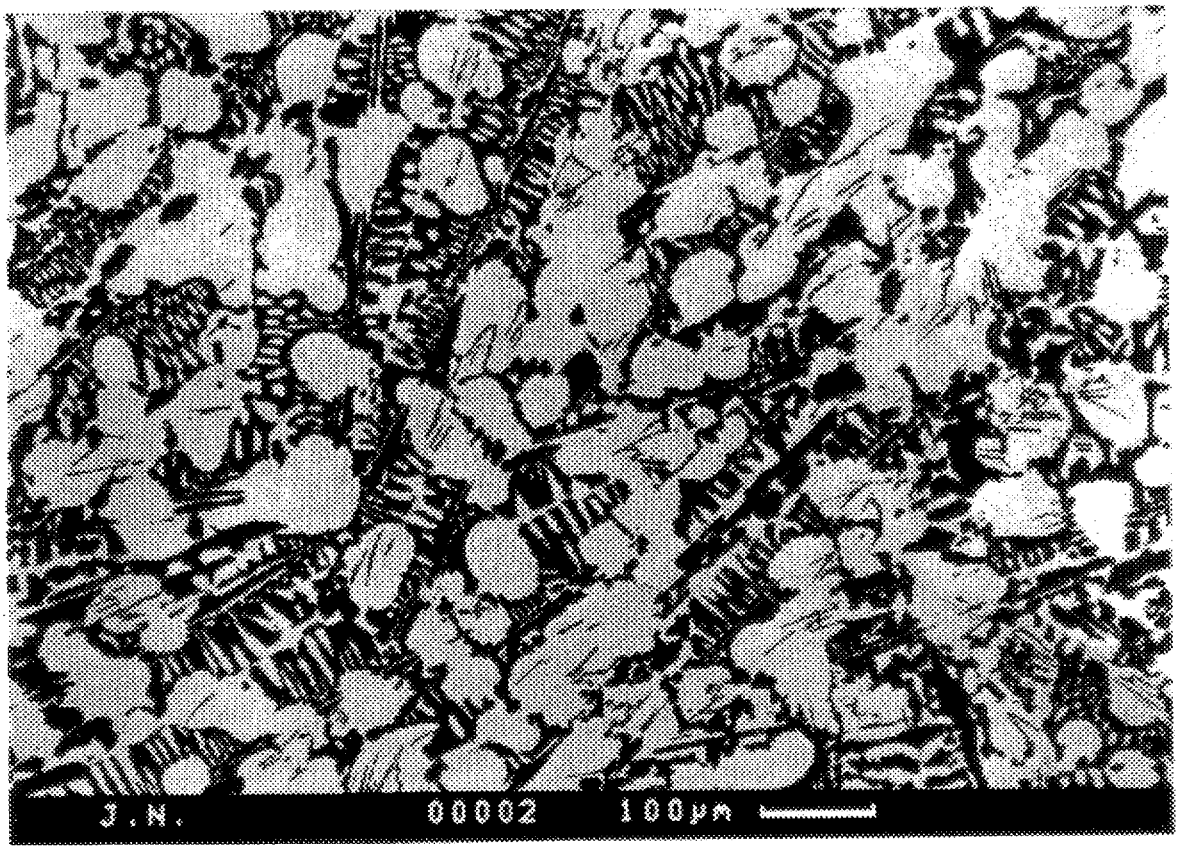
Figure 8:
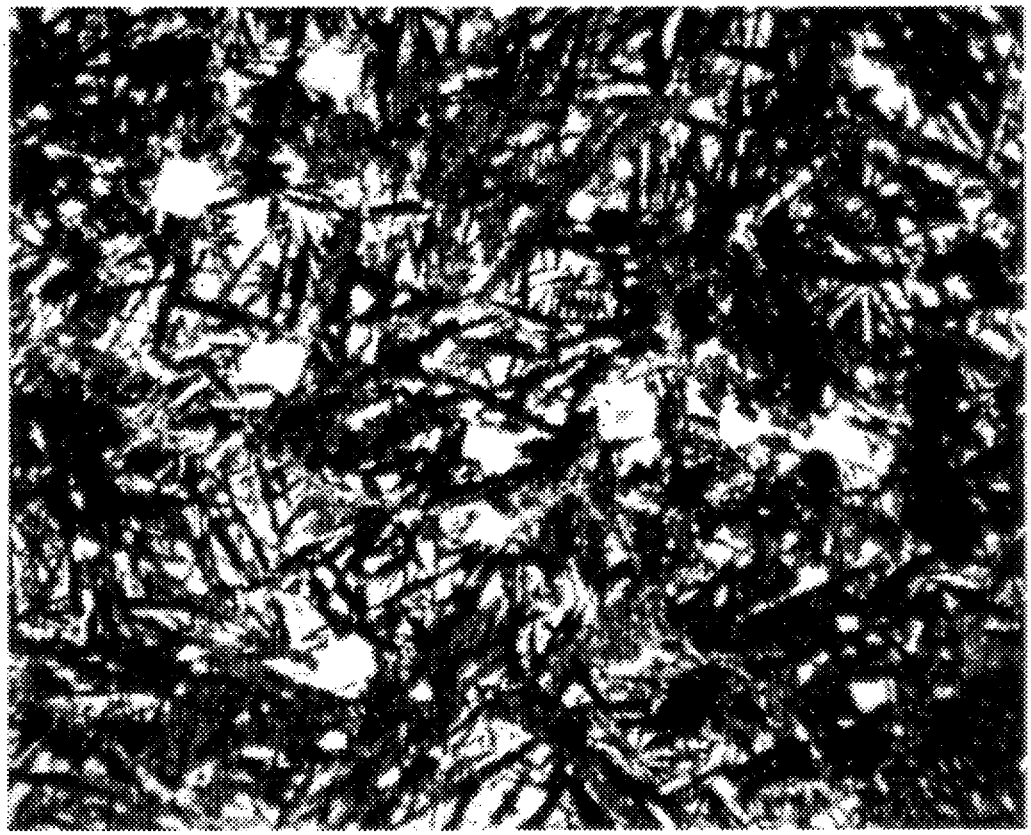
Figure 9:
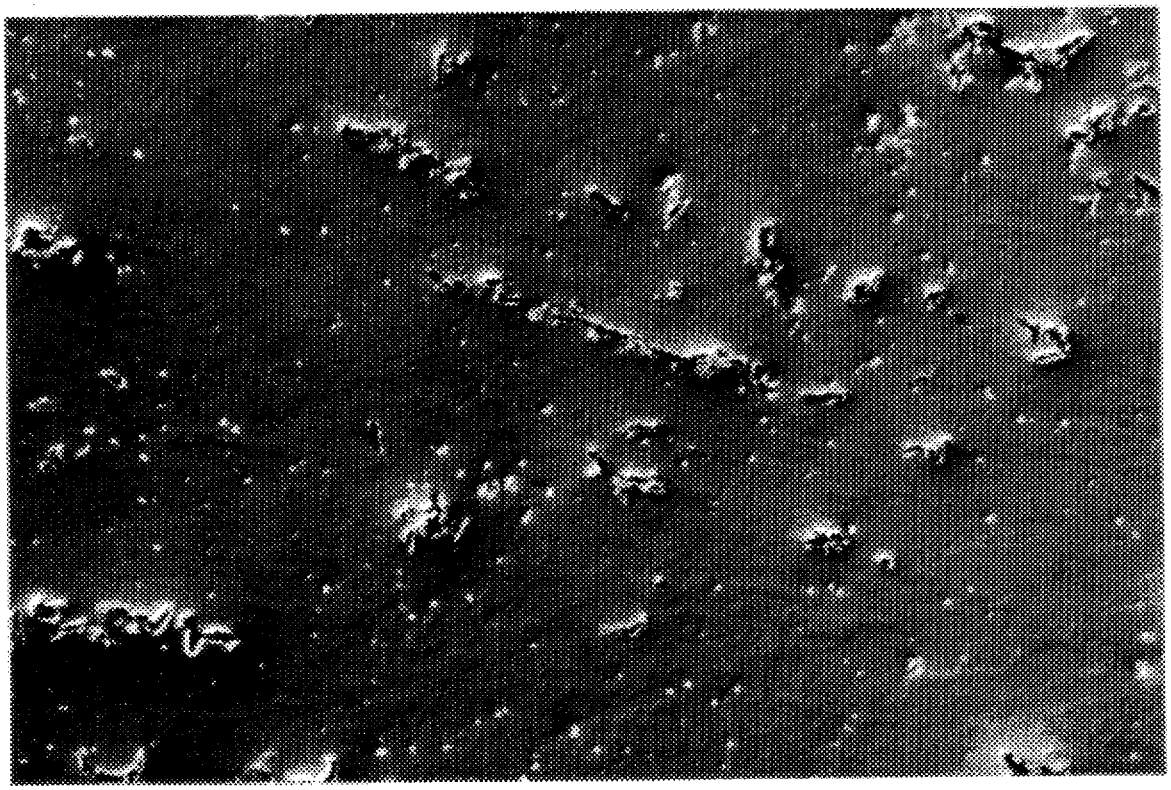
Figure 10:
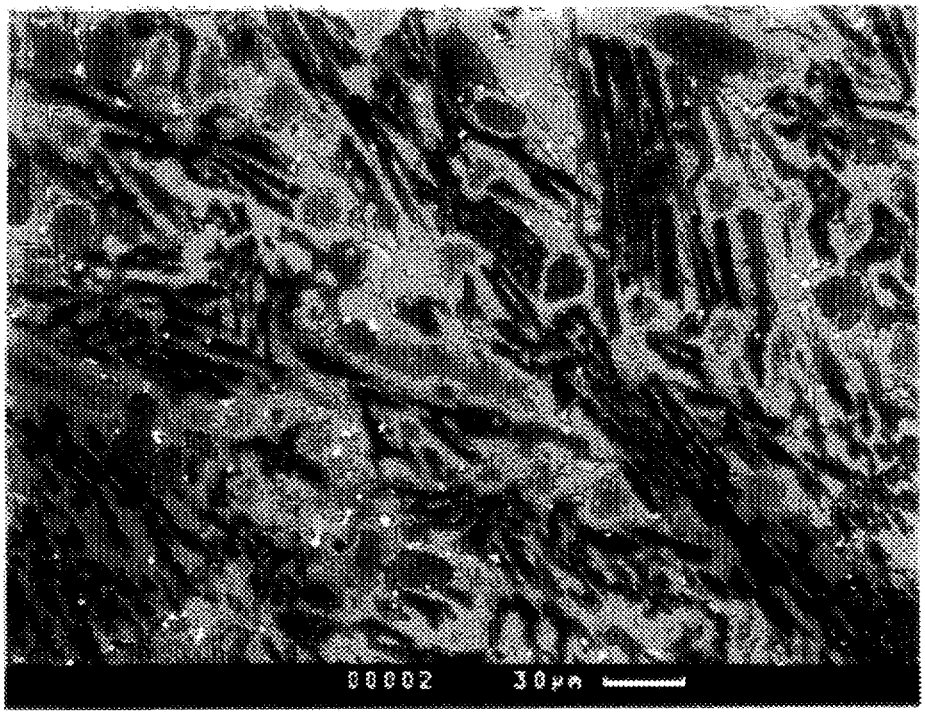
Figure 11:
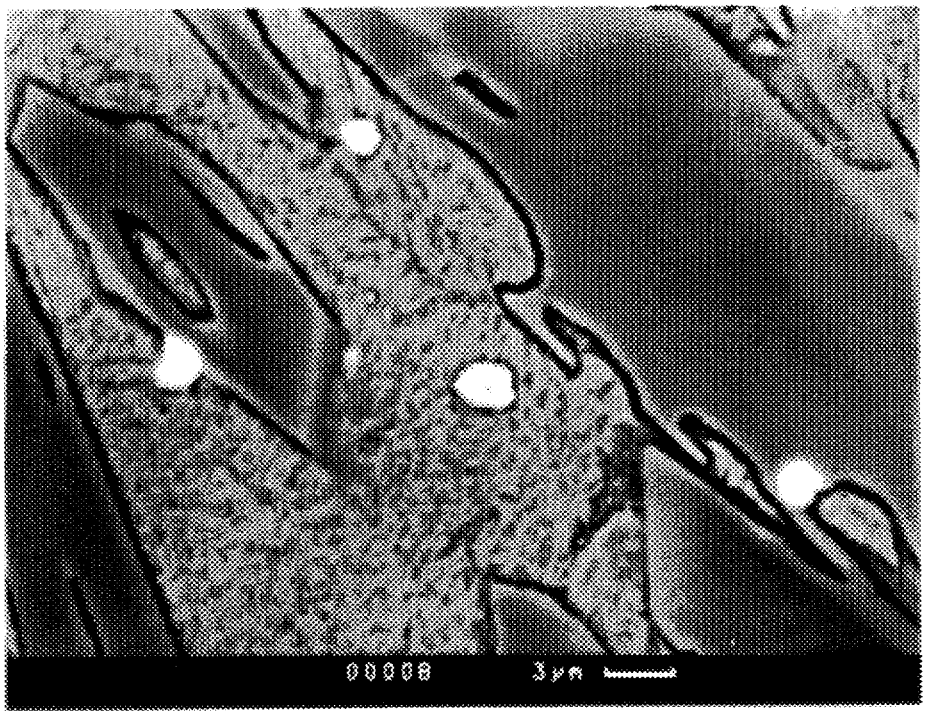

An example of the invention will now be described with reference to the accompanying drawings, wherein:

FIG. 1 is a photomicrograph showing an inner region of a shell embodying the invention at a magnification of 500, FIG. 2 is an enlargement of part of FIG. 1 at a magnification of 1,500, FIGS. 3 and 4 are similar to FIGS. 2 and 3 but of a middle region of the shell, FIGS. 5 and 6 are similar to FIGS. 1 and 2, but of an outer region of the shell, FIG. 7 is a photomicrograph of a shell of a roll of the same base composition but not embodying the invention at a magnification of ×500, FIG. 8 is a photomicrograph of a forged test piece at a magnification of ×400, FIG. 9 is a photomicrograph showing a sample of a second example of the invention at a magnification of ×300, FIG. 10 is a scanning electron micrograph showing a sample of a third example of the invention at a magnification of ×350, FIG. 11 is a scanning electron micrograph showing a sample of the third example of the invention at a magnification of ×3000, FIG. 12 is a diagrammatic illustration of a spin casting plant used in Examples I–III, FIG. 13 is a diagrammatic side elevation of another embodiment showing an electroslag remelting apparatus when in use in a method embodying the present invention, and FIG. 14 is a transverse cross-section through a consumable electrode for use in the apparatus of FIG. 13.

EXAMPLE I

In a first example an engineering ferrous metal melt comprising an indefinite chill type iron having the following composition was made in conventional manner in an induction furnace.

| | |
|---|---|
| Carbon | 3.3% |
| Silicon | 0.85% |
| Manganese | 0.50% |
| Nickel | 2.3% |
| Chromium | 1.1% |
| Molybdenum | 0.1% |
| Sulfur | 0.050% |
| Phosphorus | 0.060% |
| Iron and usual incidentals | Balance |

After the iron had been brought to operating temperature, i.e. approximately 1500° C., a powder comprises alloy carbide particles surrounded by an iron coating with a carbon content of 3.00% were added to the melt in the melting furnace in an amount equivalent to 10% weight. The powder particles had a particle size of up to 500 microns and comprised:

| | |
|---|---|
| 25% | Alpha Iron |
| 30% | Ti |
| 35% | W |
| Balance | C (of which 3% was free carbon) and usual incidentals. |

The alloy carbide particles had an average particle size of up to 10 microns and comprised a solid solution of 30% Ti and 35% W carbides and had a density of about 7 so as to match that of the iron.

The above mentioned operating temperature is higher than the usual temperature to which metal of the above composition is heated before tapping because the coating metal of the powder has a melting point of about 1520° C. and it is desirable that the metal be as hot as possible. A temperature of higher than about 1500° C. is not possible because of the tendency to "whiten" the indefinite chill iron.

The melt was then allowed to remain in the furnace for about 15 minutes to recover its operating temperature of approximately 1500° C. The molten metal was then poured into a ladle and then transferred in the ladle from the melting furnace to a conventional spin casting plant shown in FIG. 1 where the metal was poured from the ladle into the spin casting plant to form a shell S of the above described metal in conventional manner. In order to make a composite rolling mill roll metal of suitable composition, such as nodular cast iron, would then be poured to form a core C. However, the present example was concerned with providing a shell, i.e. a tubular product, and so the core metal was not poured.

The dwell time of the metal in the furnace after adding the carbide particles was about 15 minutes to allow for temperature recovery and the dwell time in the ladle before pouring into the spin casting plant was about 15 minutes. Hence, in the present example about 30 minutes elapsed after adding the carbide particles and before casting. If desired the dwell time may be longer, e.g. 1 hour or 1.5 hours or more, or may be less.

After the shell had solidified samples were taken from regions adjacent the inner, middle and outer parts of the shell and suitable samples were prepared in conventional manner to obtain the photomicrographs shown in FIGS. 1–6.

It will be seen from these photomicrographs that the added carbide particles are distributed relatively uniformly on a macroscopic scale throughout the thickness of the shell. It is particularly to be noted that the carbide particles are not segregated at grain boundaries but are distributed relatively uniformly throughout the microstructure irrespective of the phases present as a result of phase transformation during solidification and cooling. It will be also seen from FIG. 7 that the microstructure is of the same nature as in a comparison base material of the same composition but without alloy carbide particle addition.

A chemical analysis of a bulk sample was made which showed that only about half of the added carbide had been recovered to give 5 weight % of the carbide. By extra carbide we mean discrete carbide particles in addition to the carbide naturally present as a result of phase change on cooling.

From an Edax Analysis, the ratio of Ti:W in the carbide was about 4:1, but this is on an atomic % basis, and on a corresponding Wt % basis, this gives Ti:W as 1:1

The duplex nature of the carbides with a dark core suggests that the outer part of the carbide is W rich, and the inner Ti rich.

As mentioned above, the alloy carbide dispersion is uniform throughout the sample section and has an "area fraction" of about 5%, corresponding to a "volume fraction" of 5%. Whilst there is some evidence of clustering of the particles there are only a few particles in each cluster and the clustering is independent of the position of the particles in the engineering ferrous metal.

In particular there was no evidence that alloy carbide particles had been displaced ahead of the solidification interface, that is to say, the alloy carbide particle distribution was independent of the underlying microstructure.

The carbide particle size lay in the range 2–5 microns.

The hardness of the sample was tested and found to be $VHN_{30}$ 810 and the hardness of a sample cut from the comparison roll was found to be $VHN_{30}$ 650.

This increase in hardness of about 160 is somewhat greater than might be expected from the law of mixtures. It is believed that this is due to a small particle size hardening effect (Orowan hardening).

EXAMPLE II

A composite roll comprising a shell made of Indefinite chill cast iron and a nodular cast iron core was made by a spin casting technique similar to that of Example I except that in this case a finished roll was made by pouring nodular cast iron core C after completion of the shell forming stage.

In this example the shell metal had the following composition:

| | |
|---|---|
| T.C. | 3.40 |
| Silicon | 0.85 |
| Magnesium | 0.51 |
| Nickel | 4.13 |
| Chromium | 1.63 |
| Molybdenum | 0.46 |
| Sulfur | 0.13 |
| Phosphorus | 0.35 |
| Copper | 0.06 |
| Lead | 0.0013 |
| Vanadium | 0.021 |
| Titanium | 0.175 |
| Iron and usual incidentals | Balance |

This metal was again made in an induction furnace and the metal in the induction furnace was heated above the melting point of the metal to the normal operating temperature, which, for example, is approximately 200° C. above the liquidus temperature. In the present example the liquidus temperature was 1215° C. and the operating temperature was 1460° C.

The induction furnace was provided with a cover and argon was fed into the interior of the cover but may be injected into the melt. The induction coil was turned off. The powder of coated alloy carbide particles was then injected into the melt by blowing through a lance with argon or in any other desired manner. If desired, instead of argon, any other inert gas may be used, or the closed space above the melt in the induction furnace may be connected to a vacuum and particles may be added in any desired manner, for example by gravity feed, particularly where the vacuum is provided. The induction coil was then turned on so that the melt was mixed. Other techniques to avoid oxidation may be used such as, use of a flux or addition of the coated alloy carbide powder as a cored wire, although the flux may inhibit dispersion of particles in the melt and a cored wire would be expensive.

The powder of coated alloy carbide particles comprises:

| | |
|---|---|
| 27% | coating metal |
| 30% | Ti |
| 35% | W |
| Balance | Carbon (including 0.5% free carbon) and usual incidentals. |

The coating metal comprised 59% Ni and 41% iron (including up to 0.5% free carbon and usual residuals).

After a suitable dwell time as mentioned above, the metal was poured into a ladle where it remained at a temperature corresponding to the liquidus temperature plus about 170°–180° C. and then the metal was cast into the mould of the spin casting plant wherein the temperature was the liquidus temperature plus about 80°–110° C. The precise temperature depends upon the size, the smaller moulds being hotter and the larger cooler.

After the roll had solidified similar samples were taken as in Example I and FIG. 9 is an optical D.I.C. (differential interference contrast) micrograph at ×300 magnification, unetched, of a sample taken from the middle of the shell and shows a matrix with graphite flakes and small uniformly and randomly distributed alloy carbide particles. The microstructure was similar to that of Example I with the alloy coated particles being distributed throughout the matrix and the transformation carbide.

A U.T.S. test was performed on another sample from the shell and this showed the sample had a UTS of 600–700 MPa. An indefinite chill cast iron of the same composition but without the alloy carbide particles has a UTS of 385–493 MPa.

EXAMPLE III

A composite roll comprising a shell of High Chromium iron and a nodular cast iron core was made by the spin casting technique of Example II using an argon atmosphere.

The shell metal had the following composition:

| | |
|---|---|
| T.C. | 2.95 |
| Si | 1.63 |
| S | 0.035 |
| P | 0.040 |
| Mn | 0.95 |
| Ni | 0.77 |
| Cr | 17.28 |
| Mo | 2.08 |
| C | 0.93 |
| Pb | 0.0081 |
| V | 0.031 |
| Fe and usual residuals | Balance |

The powder coated alloy carbide was as described in Example I. The powder was added to the metal in amounts equivalent to 10% by weight. 5% by weight was present in the solid metal.

The metal has a liquidus temperature of 1255° C. and was heated to an operating temperature of 1560° C. The temperatures in the ladle and in the spin casting plant were related to the liquidus temperature similarly as in Example II the temperature on adding to the spin casting plant being 1345° C. After solidification of the roll samples were taken as in Example II.

FIG. 10 is a scanning election microscope micrograph at ×350 magnification of a sample taken from the middle of the shell. FIG. 11 is a similar micrograph but at ×3000 magnification. It will be seen that the discrete added alloy carbide particles are randomly and uniformly distributed and are present in both the matrix and in the transformation carbide. The carbide had largely separated into dark angular titanium rich particles about 1–10 micron in size and pinkish, rounded tungsten-rich particles generally less than about 5 micron in size. EDAX analysis revealed that the tungsten-rich particles also contains high levels of molybdenum whilst the metal itself contains low levels of titanium and tungsten in solution, both in the matrix and the transformation carbide. This points to the dissolution of the alloy carbide particles of (TiW)C in the melt, or at least their tungsten-rich outer layers, followed by their reprecipitation after solidification.

A U.T.S. test was performed on a similar sample from the shell and this showed the sample had a UTS of 800–850 MPa. A high chromium iron of the same composition but without the alloy carbide addition has a UTS of 740–830 MPa.

EXAMPLE IV

An engineering ferrous metal melt having the following composition was made in a conventional manner.

| T.C. | Si | Mn | Ni | Cr | Mo | Iron and usual incidentals |
|---|---|---|---|---|---|---|
| 0.8 | 0.28 | 0.35 | 0.5 | 2.0 | 0.25 | Balance |

After the steel had been brought to tapping temperature carbide particles of the same kind as described hereinbefore in connection with the first example were added to the melt in the melting furnace in an amount equivalent to 10% by weight.

The metal was then allowed to remain in the furnace as before to recover its tapping temperature and an ingot was then cast.

After the usual pouring section discard the ingot was 5½" in diameter and 6½" long and weighed 20 kg.

This ingot was then step forged in an open die forge to form a round bar in three reductions as follows: 2:1–4½" diameter 4:1–3½" diameter 10:1–2" diameter The resultant forging was heat treated to simulate a conventional forged roll heat treatment. Micrographs were taken at a magnification of ×400 at different positions and on transverse and longitudinal sections. These showed that the forging had a substantially uniform microstructure throughout FIG. 8 is an example of one of these micrographs taken on a longitudinal section.

It will be seen from these micrographs that the basic matrix structure was martensitic and that the added carbide particles again are distributed relatively uniformly throughout the forging. Again it was found that about half of the added carbide had been recovered to give 5% weight of the extra carbide.

EXAMPLE V

Referring now to FIGS. 13 and 14, a further embodiment is illustrated. An electroslag remelting apparatus is shown in FIG. 13 and is of essentially conventional kind comprising a cylindrical water cooled mould 10 which is movable vertically upwardly or downwardly. An electrode holder 11 holds, for example by being welded thereto, the upper end of a consumable electrode 12. Initially, the bottom end of the consumable electrode is immersed in molten slag 30 contained between a bottom plate 13 and the wall of the mould 10. Electric current is then passed to cause the lower end of the electrode to melt and as the droplets of metal fall from the lower end of the electrode 12 they pass through the slag and are refined and then solidify to form an ingot 14.

The basic operation of the electroslag remelting operation is entirely conventional as is the plant and hence further discussion is not necessary.

The consumable electrode 12 comprises an inner body 120 having welded to its external surface 121 a hollow cladding 122 which comprises a plurality of discrete tubular elements 123 in the form of tubes 124 containing powder 125.

The inner body 120 is made of low alloy steel, cast iron or mild steel such as 0.2% carbon steel.

The tubes 124 are made of mild steel in the present example but may be made of stainless steel and if desired the tubes may be made of high alloy steel or cast iron or indeed in any material of suitable composition such as

| | |
|---|---|
| Carbon | 0.5%–3% |
| Aluminium | 0.0%–1% |
| Molybdenum | 0.5%–5% |
| Vanadium | 0.0%–12% |
| Chromium | 0.5%–15% |
| Tungsten | 0.0%–8% |
| Silicon | 0.0%–3% |
| Titanium | 0.0%–8% |
| Nickel | 0.0%–5% |
| Iron and usual residuals | balance. |

Preferably, the tubes have a composition lying in the range:

| | |
|---|---|
| Carbon | 0.5%–3% |
| Aluminium | 0.0%–0.1% |
| Molybdenum | 0.5%–5.0% |
| Vanadium | 0.1%–12% |
| Chromium | 0.5%–15% |
| Tungsten | 0.1%–8% |
| Silicon | 0.0%–3% |
| Titanium | 0.1%–8% |
| Nickel | 0.1%–5% |
| Iron and usual residuals | balance. |

The tube may have the following composition:

| | |
|---|---|
| Carbon | 1% |
| Molybdenum | 2.5% |
| Vanadium | 0.7% |
| Chromium | 14% |
| Iron and usual residuals - Balance | |

The inner body may comprise a low alloy steel which may comprise:

| | |
|---|---|
| Carbon | 0.4% |
| Chromium | 1% |
| Nitrogen | up to 0.1% |
| Iron and usual residuals - Balance | |

If desired, the tubes may comprise other relatively high alloy metal such as:

| | |
|---|---|
| Carbon | 3% |
| Molybdenum | 5% |
| Vanadium | 8% |
| Nickel | 2% |
| Iron and usual residuals - balance | |
| Carbon | 1% |
| Vanadium | 12% |
| Iron and usual residuals - balance | |
| Carbon | 2% |
| Tungsten | 5% |
| Titanium | 5% |
| Iron and usual residuals - balance | |
| Carbon | 3% |
| Silicon | 2% |
| Iron and usual residuals - balance | |

If desired, the inner body may comprise other relatively low alloy metal such as:

| | |
|---|---|
| Carbon | 0.2% |
| Chromium | 0.5% |
| or | |

-continued

| | |
|---|---|
| Carbon | 3% |
| Silicon | 2% |
| or plain cast iron or mild steel. | |

However, the tubes may be provided solely to hold the powder 125 so could be composed of material of the same composition as the inner body or indeed may be made of suitable non-metallic material, such as silica, of a melting point so as to melt in the bath at a desired rate to release the alloying addition. The above described materials are applicable to hollow cladding of any suitable configuration.

In the present example the tubes have the following composition:

| | |
|---|---|
| Carbon | 0.2% |
| Iron and usual residuals - balance | |

The powder comprises a mixture of coated alloy carbide particles as described hereinbefore in connection with Example I (but may be any of the other coated alloy carbide particles described hereinbefore) and of particles of an alloying ingredient or ingredients.

For example, the powder may comprise:

| | |
|---|---|
| Carbon | up to 10% (with 5% as graphite) |
| Tungsten | 35–40% |
| Titanium | 30–40% |
| Iron, carbide and usual residuals - | balance |

Some of the carbon is combined with the Tungsten and the Titanium as intermetallic compound but the Tungsten and Titanium are combined as a solid solution and a proportion of the Carbon present is as free graphite.

In the present example, the powder mixture has the following composition:

| | |
|---|---|
| Chromium | 2% |
| Tungsten | 40% |
| Titanium | 40% |
| Molybdenum | 1% |
| Vanadium | 1% |
| Carbon | 6% |
| Iron, carbide and usual residuals | Balance |

Alternatively, the powder mixture has the following composition:

| | |
|---|---|
| Chromium | 2% |
| Tungsten | 35% |
| Titanium | 30% |
| Molybdenum | 1% |
| Vanadium | 1% |
| Carbon | 6% |
| Iron, carbide and usual residuals | Balance |

In general, one or more of the alloying elements may be present in the powder mixture, either as elements or combined with the carbon as inter-metallic compound or alloy.

| |
|---|
| Carbon |
| Molybdenum |
| Chromium |
| Tungsten |
| Titanium |
| Vanadium |
| Niobium |

If desired the powder may be made of a powdered alloy of any one of the compositions or range of compositions described as being suitable for the tubes mentioned above or may be made of alloy of other compositions or of components which provide such compositions.

The amount of carbide particles added is such as to achieve up to 1–20% by volume of carbide particles in the surface part.

The tubes 124 in the present example are 16 mm OD, 13 mm ID but may lie in the range from 6 mm ID to 28 mm ID with appropriate OD.

The tubes are provided with restrictions at intervals along their length so as to hold discrete amounts of carbide powder at positions along the length of the tubes, for example, such restrictions may be provided every 10 cm.

In the present example the restrictions are provided by crimping the tubes so as to close or substantially to close their bore but, of course, such restrictions may be provided in any other desired way.

In the present example the tubes 124 are attached to the inner body 120 so as to extend longitudinally thereof parallel to the longitudinal axis of the inner body but, if desired, a single tube or tubes may be wound helically around the inner body or one or more tubes may extend circumferentially around the body so as to lie in a plane which is perpendicular to the longitudinal axis of the inner body so long as the tubes are of the correct size to hold the correct amount of powder to be released into the melt at the longitudinal position of the body.

Further alternatively, one or more tubes may be arranged to extend around the inner body in a plane or respective plane which is inclined to the longitudinal axis of the inner body at less than a right angle.

Although in this case cladding is in the form of discrete elements provided by the tubes 124 containing powder 125, if desired, the cladding may comprise a hollow sleeve, for example, a sleeve comprising inner and outer generally cylindrical walls inter-connected by generally annular shaped walls with the space between the walls containing powder as described hereinbefore and the sleeve being mounted, for example, by welding or by virtue of being a push fit on the inner body. In this case the hollow sleeve is provided with restrictions in its wall at suitable positions along the length of the sleeve so as to divide the powder into discrete amounts for release into the melt pool sequentially as the sleeve and inner body are melted.

In the present example the melting points of an alloy added with the carbides, for example Tungsten, Titanium solid solution, which can at least partly melt in the melt bath and of the alloy carbides are greater than the melting point of the slag 30 and of the inner body 120 of the consumable electrode 12. The melting point of the cladding tube/sleeve metal of the tubes and/or of any alloy ingredient may be 40° C. below the melting point of the inner part 20 and 60° C. above the melting point of the slag 30. The melting point of the tubes 22 is, in the present example, 1530° C.

The inner part may have a melting point lying in the range 1160° C. to 1600° C. and the cladding may have a melting point lying in the range 1160° C. to 1600° C.

The melting point of the inner and outer parts may differ by 20° C. to 60° C. The slag may have a melting point which differs from the lower of the melting point of the inner part and the cladding by 20° C. to 60° C.

The mould is water cooled to a temperature lying in the range of 15° C. to 65° C. and the molten metal pool 31 has a temperature lying in the range 1400° C. to 1600° C. may be in the range 1160° C. to 1600° C.

The voltage and current used in the electroslag remelting operation are manipulated so that there is a relatively high voltage and a relatively low current, or vice versa and in addition the composition of the slag is adjusted so as to provide a relatively viscous slag. As a result turbulence in the slag and the melt pool are minimised so that a desired composition gradient is achieved.

In addition, the voltage and current used are manipulated so that the floor of the melt pool is relatively flat.

The metal droplets leaving the cladding of the electrode, including the contents thereof, are more dense than the metal droplets leaving the inner body of the electrode when they are more highly alloyed. This results in the droplets from the cladding of the electrode falling downwardly adjacent to the wall of the mould and, because the floor of the melt pool is relatively flat, there is relatively little tendency for these droplets to run towards the middle of the melt pool before they have solidified as a result of their spatial and temperature proximity to the mould wall.

The composition of the slag is adjusted to reduce the ionic capacity of the slag by adjusting the balance of the silicon, calcium and aluminium in the slag to reduce the tendency for electromagnetic stirring as well as the composition of the slag being adjusted to provide a relatively higher viscosity.

Typically the slag has the following composition: 33⅓% CaO, 33⅓% $CaF_2$, 33⅓% $Al_2O_3$.

However the slag may have a composition lying in the range to 20% CaO, 80% $CaF_2$, 0% $Al_2O_3$.

The cooling rate provided by the water cooling to the mould may be adjusted by adjusting the raw temperature of the mould to lie in the range 15° C. to 65° C. In addition, the rate of movement of the mould may also be adjusted.

Typically, the electrode has a diameter which is about 0.9% of the diameter of the mould cavity.

The electrode is arranged so that approximately 20%, by weight, of the electrode comprises cladding and the balance is provided by the inner body. This ratio may lie in the range 1% to 40%.

Although above the melting point of the cladding has been described as being lower than the melting point of the metal of the inner body, if desired this may be reversed.

As the electrode 12 melts, droplets of liquid metal are solid particles of the metal carbide which does not melt, from the tubes 124 and powder 125 fall generally vertically downwardly and because of the relatively close spatial and temperature proximity to the wall of the mould 110 the droplets solidify relatively rapidly, at or adjacent to the mould wall and the carbide particles are trapped by the solidifying melt adjacent the mould wall, so that the metal at the surface of the ingot 14 has a relatively high uniform distribution of alloy and alloy carbides as well as having a composition of matrix substantially similar to the composition of the metal of the tubes 124.

The metal droplets falling from the middle of the bottom of the inner part fall vertically downwardly and thus the metal solidifying at the centre of the ingot has a composition substantially similar to the composition of the inner part of the electrode.

This is facilitated where metal from the cladding is of greater density than the metal from the inner body as this causes the droplets to fall downwardly adjacent to the mould wall together and by the hereinbefore mentioned precautions to avoid mixing, low slag viscosity, low slag electromagnetic stirring and a relatively flat melt pool base.

Between these two extremes there is limited mixing of the material from the two regions so that a change in composition between the two extremes takes place without discontinuity. Accordingly, the ingot has a relatively uniform transition region between the inner part and the surface part. The ingot, and hence any resulting product such as a roll as described hereinbefore, has an elastic modulus which increases in direct proportion to the amount of the distribution of the alloy/alloy carbide through the ingot cross-section.

In the present example the composition at the surface of the ingot is:

| | |
|---|---|
| Carbon | 0.5% |
| Molybdenum | 0.2% |
| Vanadium | 0.9% |
| Tungsten | 1.2% |
| Chromium | 0.5% |
| Titanium | 0.15% |
| Iron, carbide and usual residuals | balance |

The composition at the centre of the ingot is:

| | |
|---|---|
| Carbon | 0.5% |
| Molybdenum | 0.1% |
| Tungsten | 0.3% |
| Titanium | 0.03% |
| Vanadium | 0.2% |
| Chromium | 0.5% |
| Iron, carbide and usual residuals | balance |

The variation in composition is believed to arise due to the relatively higher diffusion of chromium and carbon compared with the relatively lower diffusion and more dense tungsten and titanium.

The composition gradient does not exceed 40% per 100 mm in the radial direction and this condition applies with any position along the longitudinal extent of the roll.

EXAMPLE VI

In this example, the electroslag remelting apparatus and method of operation described in connection with Example V may also used but with the operating conditions modified so as to aim to provide a uniform composition roll, for example the voltage and current used manipulated so that the floor of the melt pool is relatively deep. Generally, conventional operating conditions and slag compensations were used.

An electrode comprising an inner part, with an outer cladding of tubular configuration both made of low carbon steel was made with the space therebetween containing alloy carbide powder as described in connection with Example V. Quantities were calculated for a target addition of 1 wt %.

A conventional electroslag remelting operation was performed.

Hardness tests were performed on the remelting roll and this revealed that throughout the majority of the cross-section of the roll a hardness of around Hv 250 was achieved.

This is considerably above that expected according to the law of mixtures where for a 1% addition of carbide (Hv approximately 3000) to a low carbon steel (Hv approximately 180) a value of around Hv 210 is expected.

Examination of the microstructure revealed a good uniform and random dispersion of added carbide particles with a volume approaching 1% by weight.

EDAX analysis of individual carbide particles shows a strong presence of titanium with only traces of tungsten. This suggests that solution of tungsten from the particles has occurred in the melt. This would retard the pearlite transformation cooling allowing a bainitic structure to develop and thus giving a greater hardness due to the modification of phase transformations in this way.

Moreover, since the low carbon steel of this example contained about 0.1% nitrogen it is considered that at least some of this nitrogen has formed titanium carbo-nitride particles and hence that at least some of the above mentioned carbide particles comprise such titanium carbo-nitride particles which may also contain tungsten.

Unless otherwise stated compositions are expressed herein in % by weight.

References to particle size are to the largest dimension of the largest particle unless otherwise described.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

We claim:

1. A method of making an engineering ferrous metal comprising the steps of adding to liquid engineering ferrous metal solid alloy carbide particles and thereafter permitting the ferrous metal to solidify wherein the alloy carbide particles have a density matching the engineering ferrous metal density and the solid alloy carbide particles are coated with a metal which allows wetting to occur between the particles and the liquid engineering ferrous metal.

2. The method according to claim 1 wherein the coating metal is selected from the group consisting of iron, an iron carbon alloy, nickel, copper, an alloy of at least two elements selected from the group consisting of iron, nickel, copper, titanium, and carbon, and further comprising usual incidentals, and optionally nitrogen.

3. The method according to claim 1 wherein the coating metal has a melting point which matches the operating temperature of the ferrous metal.

4. The method according to claim 1 wherein the alloy carbide particles are coated with a metal selected from the group consisting of iron and an iron alloy having a lower carbon content than that of the engineering ferrous metal to which they are added and the coated alloy carbide particles are added to the engineering ferrous metal and permitted to dwell therein sufficiently long for carbon from the engineering ferrous metal to diffuse into the coating and so produce a composition which has a melting point which matches the operating temperature of engineering ferrous metal.

5. The method according to claim 1 wherein the coated alloy carbide particles are added to the liquid engineering ferrous metal in an expedient selected from the group consisting of: in the melting furnace; in a ladle into which the metal has been poured from the melting furnace; in the stream of metal being poured from the melting furnace to the ladle, and in the stream of metal being poured from the ladle into a mould.

6. The method according to claim 1 wherein the coated alloy carbide particles are added to the engineering ferrous metal in an inert environment.

7. The method according to claim 1 wherein the coated alloy carbide particles are added to the engineering ferrous metal melt in the form of a powder comprising powder particles having a particle size of up to 2 mm and containing alloy carbide particles having a particle size of up to 10 microns.

8. The method according to claim 1 wherein the coated alloy carbide particles are added to the engineering ferrous metal melt in the form of a powder wherein the powder particles comprise:

| | |
|---|---|
| 25 weight % | coating metal. |
| 30 weight % | Ti |
| 35 weight % | W |
| Balance | Carbon (including up to 3.5 weight % free carbon) and usual incidentals. |

9. The method according to claim 1 wherein the coating metal comprises at least substantially wholly alpha iron and up to 3.5 weight % free carbon.

10. The method according to claim 1 wherein the coated alloy carbide particles are added to the engineering ferrous metal melt in the form of a powder wherein the powder particles comprise:

| | |
|---|---|
| 27% | coating metal. |
| 30% | Ti |
| 35% | W |
| Balance | Carbon (including up to 0.5% free carbon) and usual incidentals. |

11. The method according to claim 1 wherein the coating metal comprises an alloy of iron, nickel and carbon.

12. The method according to claim 11 wherein the alloy of iron, nickel and carbon comprises:

| | |
|---|---|
| 59% | nickel |
| 41% | iron and up to 0.5% free carbon and usual incidentals. |

13. The method according to claim 1 wherein the coated alloy carbide particles are added during an electroslag remelting operation.

14. The method according to claim 1 wherein the alloy carbide is selected from the group consisting of chromium, molybdenum, titanium, tungsten, niobium, vanadium, mixed carbides thereof, and mixed carbo-nitrides.

15. The method according to claim 1 wherein the carbide is a mixed tungsten titanium carbide of the kind (TiW)C where the ratio of titanium to tungsten is about 1:1 by weight.

16. The method according to claim 14 wherein the alloy carbide comprises Ti and W in the ratio range:

1:1 to 1:1.17.

17. The method according to claim 1 wherein the alloy carbide particles have a maximum dimension selected from the group consisting of up to 10 microns, 1–5 microns, and 2–5 microns.

18. The method according to claim 1 wherein the amount of alloy carbide particles added is such as to achieve up to 20% by volume of alloy carbide particles in the solid metal.

19. The metal according to claim 18 wherein the alloy carbide content is selected from the range consisting of 0.1 to 20% by volume, and 3 to 10% by volume, when a hardening effect based on the law of mixtures is provided.

20. The method according to claim 18 wherein the alloy carbide content is selected from the range consisting of 1% to about 0.5%, and from 1% to not more than about 0.1%, when a hardening effect based on a modification of the transformation of the microstructure is provided.

21. The method according to claim 1 wherein the engineering ferrous metals are selected from the group consisting of steel, cast iron having a carbon content in the range of 0.3–3.8%, cast iron having a carbon content in the range of 0.3–3.8% and containing nitrogen, iron, chromium iron, high alloy steel, tool steel, medium alloy steel, low alloy steel, and S.G. iron.

22. An engineering ferrous metal product comprising an iron carbon alloy having a microstructure which has resulted from phase transformation on cooling and having dispersed therein discrete alloy carbide particles wherein the alloy carbide has a composition so that the alloy carbide density matches the engineering ferrous metal density.

23. The product according to claim 22 wherein the microstructure comprises a matrix and transformation carbide which have resulted from phase transformation of the engineering ferrous metal.

24. The product according to claim 23 wherein the discrete alloy carbide particles are distributed in the matrix.

25. The product according to claim 23 wherein the discrete alloy carbide particles are distributed in the transformation carbide.

26. The product according to claim 22 wherein the discrete alloy carbide particles are uniformly distributed in the microstructure.

27. The product according to claim 22 wherein the alloy carbide is selected from the group consisting of chromium, molybdenum, titanium, tungsten, niobium, vanadium, mixed carbides thereof, and mixed carbo-nitrides.

28. The product according to claim 22 wherein the alloy carbide has a composition so that the density of the alloy carbide matches that of the engineering ferrous metal.

29. The product according to claim 22 wherein the carbide is a mixed tungsten titanium carbide of the kind (TiW)C where the ratio of titanium to tungsten is about 1:1 by weight.

30. The product according to claim 29 wherein the alloy carbide comprises Ti and W in the ratio range:

1:1 to 1:1.17.

31. The product according to claim 22 wherein the alloy carbide particles have a maximum dimension selected from the group consisting of up to 10 microns, 1–5 microns, and 2–5 microns.

32. The product according to claim 22 wherein the amount of alloy carbide particles added is such as to achieve up to 20% by volume of alloy carbide particles in the solid metal.

33. The product according to claim 32 wherein the alloy carbide content is selected from the range consisting of 0.1 to 20% by volume, and 3 to 10% by volume, when a hardening effect based on the law of mixtures is provided.

34. The product according to claim 32 wherein the alloy carbide content is selected from the range consisting of from 1 weight % to about 0.5 weight %, and from 1 weight % to not more than about 0.1 weight %, when a hardening effect based on a modification of the transformation of the microstructure is provided.

35. The product according to claim 32 wherein the engineering ferrous metal is selected from the group consisting of steel, cast iron having a carbon content lying in the range of 0.3 weight %–3.8 weight %, cast iron having a carbon content in the range of 0.3 weight %–3.8 weight % and containing nitrogen, iron, chromium iron, high alloy steel, tool steel, medium alloy steel, low alloy steel, and S.G. iron.

36. A method of making a rolling mill roll comprising casting an engineering ferrous metal to make at least an outer part of the rolling mill roll, said engineering ferrous metal made according to a method comprising the steps of adding to liquid engineering ferrous metal solid alloy carbide particles and thereafter permitting the ferrous metal to solidify wherein the alloy carbide particles have a density matching the engineering ferrous metal density and the solid alloy carbide particles are coated with a metal which allows wetting to occur between the particles and the liquid engineering ferrous metal.

37. The method according to claim 36 wherein the rolling mill roll is a composite rolling mill roll of the kind having a core and an outer shell with, optionally, at least one intermediate layer, in which the shell comprises said outer part.

38. The method according to claim 37 wherein the alloy carbide particles are introduced into a molten engineering ferrous metal of which the shell is to be formed and then the engineering ferrous metal with the alloy carbide particles therein is poured into a mould.

39. The method according to claim 37 wherein the composite roll is made by centrifugal casting.

40. The method according to claim 37 wherein the roll is made by performing an electroslag remelting operation on a consumable electrode which comprises an inner body provided with an external cladding comprising a hollow element containing said coated alloy carbide particles.

41. The method according to claim 40 wherein the hollow element also contains a powder alloy ingredient.

42. The method according to claim 40 wherein the electroslag remelting operation is performed to provide a roll comprising an inner part having a first composition and a surface part having a second composition which is different from the first composition and the metal of the roll between the inner part and the surface part having a composition which changes from the first composition to the second composition without discontinuity.

43. The method according to claim 40 wherein the electroslag re-melting is performed to provide a roll of substantially uniform composition throughout the cross-section of the roll.

44. The method according to claim 37 wherein the roll is made by ESR cladding or spray cladding.

45. The method according to claim 36 wherein the roll is made by monobloc static casting by filling a stationary mould with a single engineering ferrous metal.

46. The method according to claim 37 wherein a roll is made by a double poured static casting method.

47. The method according to claim 36 wherein a roll is made by casting an ingot of said metal and then forging the ingot to provide a forged roll followed by heat treating the forged roll.

48. The method according to claim 37 wherein the core comprises a metal selected from the group consisting of flake, compact, vermicular, and nodular cast iron, and steel.

49. A method of making a spun cast product comprising pouring a metal made according to claim 1 into a spin casting mould and performing a spin casting operation thereon.

50. The method according to claim 1 wherein the coating metal is selected from the group consisting of iron, and iron carbon alloy, nickel and copper.

51. The method according to claim 1 wherein the alloy carbide is selected from the group consisting of chromium, molybdenum, titanium, tungsten, niobeium, vanadium, and mixed carbides thereof.

52. The method accordingly to claim 1 wherein the alloy carbide particles have a maximum dimension lying in the range 1–10 microns and preferably 1–5 microns.

53. The method according to claim 1 wherein the amount of alloy carbide particles added is such as to achieve 5–20% by volume of carbide particles in the solid metal.

54. The method according to claim 1 wherein the engineering ferrous metals are selected from the group consisting of steel, cast iron having a carbon content in the range of 0.3–3.8%, indefinite chill cast iron, chromium iron, high alloy steel, medium alloy steel, low alloy steel, and S.G. iron.

55. A product according to claim 22 wherein the alloy carbide is selected from the group consisting of chromium, molybdenum, titanium, tungsten, niobium, vanadium, and mixed carbides thereof.

56. A product according to claim 22 wherein the alloy carbide particles have a maximum dimension lying in the range 1–10 microns and preferably 1–5 microns.

57. A product according to claim 22 wherein the amount of alloy carbide particles added is such as to achieve 5–20% by volume of alloy carbide particles in the solid metal.

58. A product according to claim 32 wherein the engineering ferrous metal is selected from the group consisting of steel, cast iron having a carbon content lying in the range of 0.3–3.8%, indefinite chill cast iron, chromium iron, high alloy steel, medium alloy steel and S.G. cast iron.

59. The method according to claim 37 wherein the core comprises a metal selected from the group consisting of flake cast iron, nodular cast iron and steel.

60. A product according to claim 22 wherein the product comprises at least an outer part of a rolling mill roll.

* * * * *